United States Patent [19]

Wedertz et al.

[11] 4,411,398

[45] Oct. 25, 1983

[54] DOUBLE FABRIC RETRACTABLE WING CONSTRUCTION

[75] Inventors: Larry D. Wedertz, Mira Loma; Oakley G. Ross, Upland; Byron M. Niemeier, Claremont, all of Calif.

[73] Assignee: General Dynamics, Pomona Division, Pomona, Calif.

[21] Appl. No.: 255,413

[22] Filed: Apr. 20, 1981

[51] Int. Cl.[3] ..... F42B 13/32

[52] U.S. Cl. ..... 244/3.28

[58] Field of Search ..... 244/3.1, 3.24, 3.27, 244/3.28, 3.29, 49, 218; 102/348, 371, 385, 400

[56] References Cited

U.S. PATENT DOCUMENTS

| | | | |
|---|---|---|---|
| 3,826,448 | 7/1974 | Burk, Jr. | 244/3.27 |
| 3,986,685 | 10/1976 | Marburger et al. | 244/3.28 |
| 4,106,727 | 8/1978 | Ortell | 244/218 |

*Primary Examiner*—Stephen C. Bentley
*Assistant Examiner*—Maureen Ryan
*Attorney, Agent, or Firm*—Neil F. Martin; Earl F. Kotts; Edward B. Johnson

[57] ABSTRACT

A simple, retractable, self-erecting wing for a low speed missile having a fabric wing cover affixed to a leading edge structure that is the only erected structural member in the wing operative position. The wing cover forms a pocket that contains air. The leading edge structure is hinged and folds, along with the wing cover, into a compact slotted space adjacent the outer wall of a missile body. In the folded position the leading edge structure forms a cover for the slot and the cover coincides with the outer shape of the missile body. A large fabric wing can be completely stored within the missile body for minimum drag during any high speed portion of the missile flight, the wing being released to the operative position by a simple mechanism.

3 Claims, 7 Drawing Figures

DOUBLE FABRIC RETRACTABLE WING CONSTRUCTION

BACKGROUND OF THE INVENTION

In co-pending application Ser. No. 077,966 for "Double Fabric, Retractable, Self-Erecting Wing for Missiles", a retractable wing is disclosed using a flexible fabric wing cover. The wing is stored within the missile body in the retracted position. The wing is extended into the operative position by a signal and forms an internal air pocket which damps fluttering caused by uneven air flow or turbulence. This type of wing avoids problems encountered with more conventional structures such as fins which fold against the exterior of the missile body and cause undesirable drag at high speeds. Such fins do not provide symmetrical lift because of the necessity to shape them to fit the missile body in the stored position. Large wings which retract into the body normally consume considerable space. Single layer flexible wings are subject to aerodynamic flutter and bow upwardly to form an undercambered single surface air foil which can flutter or collapse under sudden changes in load condition.

The present invention provides a wing construction of the type described in the co-pending application. It is a simpler construction which utilizes a small number of parts. In addition, due to the arrangement of the single leading edge member, a larger wing can be accommodated.

SUMMARY OF THE INVENTION

The sole wing strut member with an unencumbered end portion disclosed herein enables the use of a large fabric wing cover. A hinge connection in the strut member permits such a large wing cover to be stored within a small space within the missile body. The strut member provides a cover for the storage space when the wing is in the stored position. The result in a simple construction which has relatively few parts and less chance for error in operation than other such constructions.

DETAILED DESCRIPTION OF THE INVENTION

Figure 1:
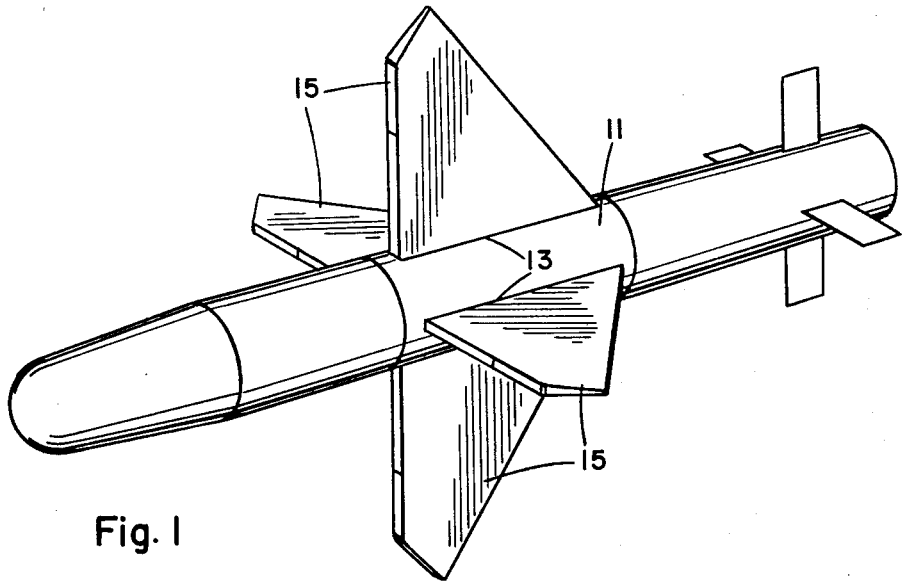
FIG. 1 is a perspective view of a typical missile showing wings constructed in accordance with the present invention in the extended position.

A missile is illustrated in FIG. 1 of the drawings and has a cylindrical body 11 with circumferentially spaced longitudinal slots 13 with self erecting wings 15 extending from the slots. An arrangement of four wings is shown, but any suitable number can be used. The missile may have any required configuration of war head, guidance and propulsion means to suit a specific operation. The wings are identical and the structure and mechanism for one wing will be described.

Figure 7:
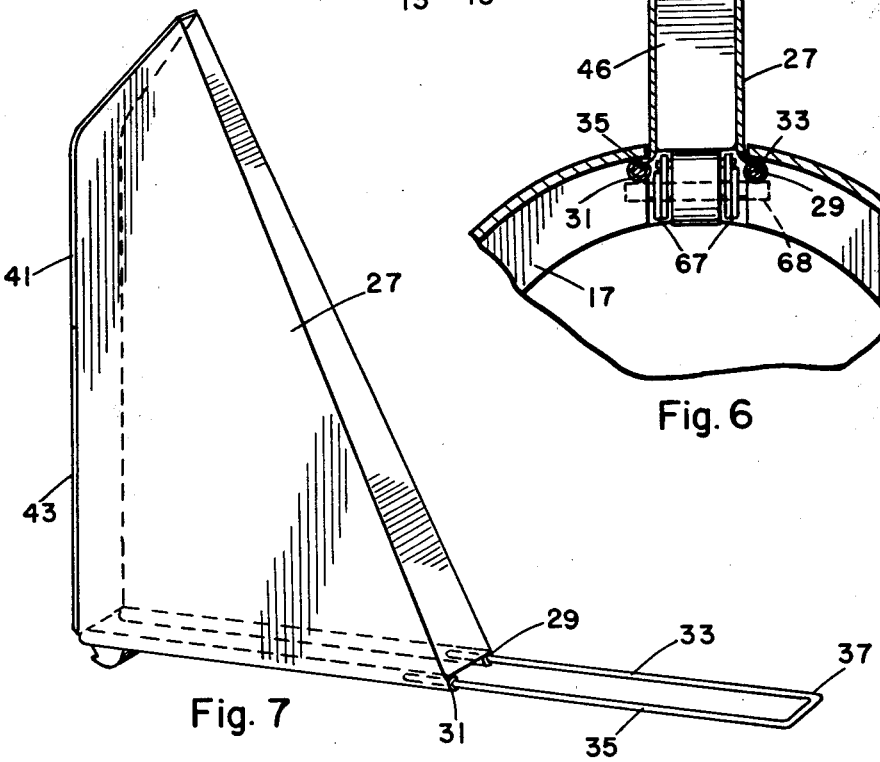
FIG. 7 is a perspective view of one of the wings in the extended position and showing the rod which retains the base of the wing cover member in the missile storage compartment.

Wing 15 is mounted between a forward bulkhead 17 and a rear bulkhead 19 which are part of the body structure. The wing has a leading edge strut formed by an outer strut plate member 23 and an inner strut plate member 25 of a lightweight metal with a fabric wing cover 27 sandwiched therebetween. The wing cover is constructed of a flexible fabric material, such as reinforced plastic, plastic, or rubber impregnated woven fabric, preferably impervious to air. The flexible wing cover permits folding of the wing into the stored position shown in FIG. 2 of the drawings. The trailing edge of the wing has no strut and can adjust to air flow at that point. The base of the wing cover 27 has tubular portions 29 and 31 (FIGS. 3 and 7) at the closed bottom of the wing cover which extend around the legs 33 and 35 of a substantially U-shaped rod 37. The legs extend into and are secured to the forward bulkhead 17 and the bend in the rod is seated in notch 39 in rear bulkhead 19. When the wing 15 is folded into the stored condition the wing cover folds are tucked between legs 33 and 35 of rod 37. The backward sweep of the upper end of the leading edge strut helps to retain the folded wing cover in well-arranged, stored condition.

Figure 2:
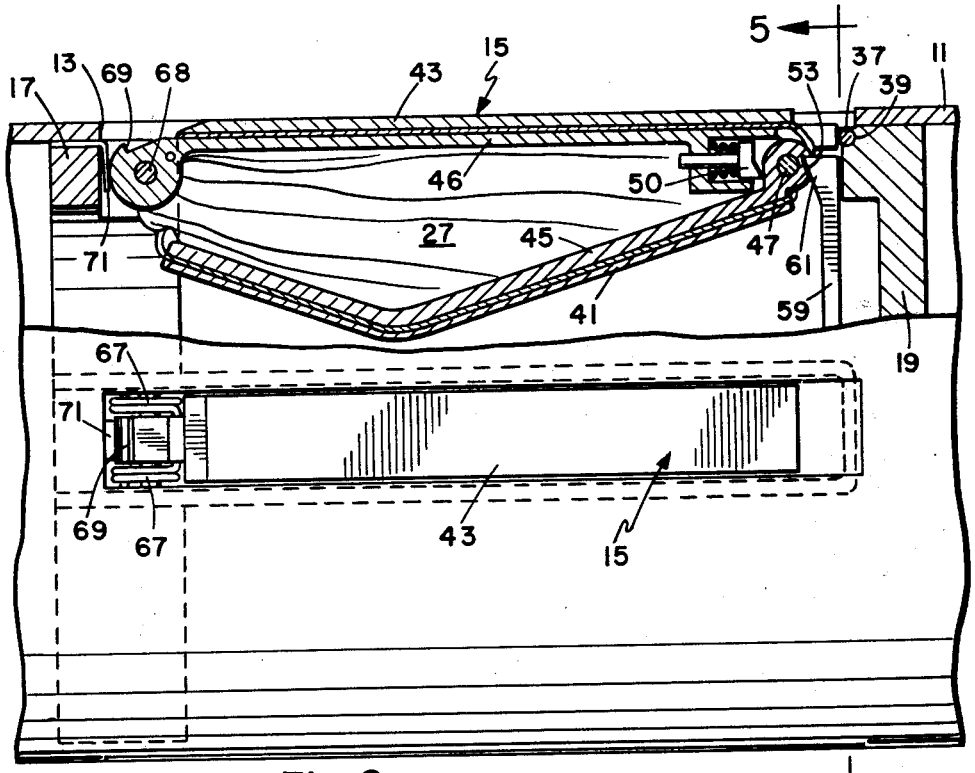
FIG. 2 is an enlarged side elevation view of the wing carrying section of the missile with the wing shown in the retracted and stored position.
Figures 3, 4:
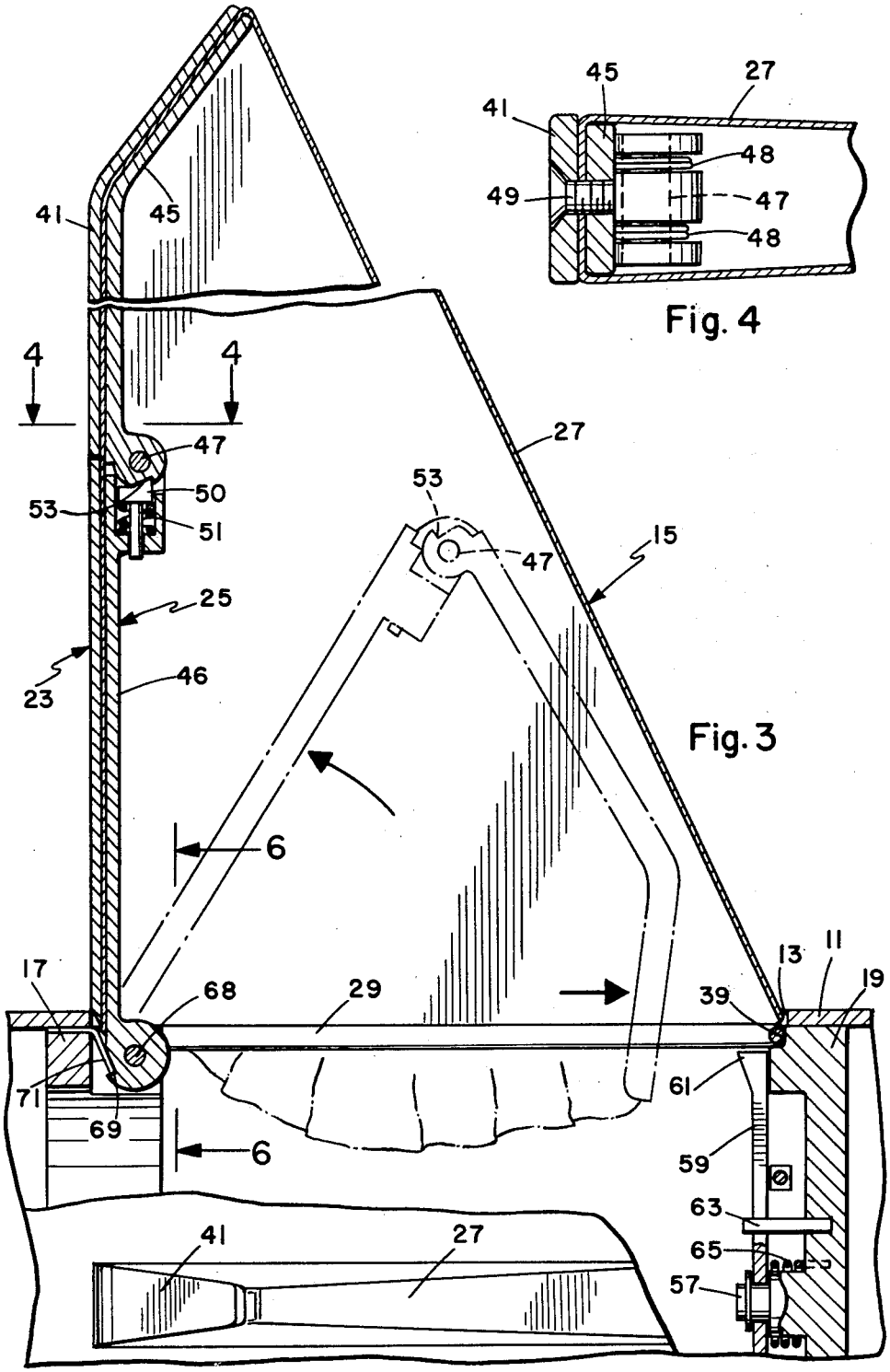
FIG. 3 is a partially sectioned side elevation view of a portion of the missile body showing the wing in the extended operative position.
FIG. 4 is a sectional view taken on line 4—4 of FIG. 3.

The outer strut plate member 23 includes two sections 41 and 43 and the inner strut plate member 25 includes two sections 45 and 46. The strut plate sections 41 and 45 are rotatable about hinge pin 47 so that the upper portion of the wing 15 can be folded into a stored position as shown in FIG. 2. The upper strut plate sections 41 and 45 are urged toward the expanded position by springs 48 (FIG. 4). The inner and outer strut plate sections are fastened together by suitable means such as the screw member 49. A keeper 50 is urged outwardly by spring 51 as shown in FIG. 3 to engage lip 53 and hold the strut plate sections in the open position when the wing is extended. The leading edge structure is foldable as shown in broken lines in FIG. 3, and is folded into the stored position shown in FIG. 2 within the storage compartment formed by the slot in the missile body 11. The swept back upper end portion of the wing leading edge strut aids in holding the folded wing cover 27 in position. The plate section 43 fits the contour of the missile body and forms a cover for the slot 13, thus eliminating the need for a separate cover and a means to remove it in flight.

Figure 5:
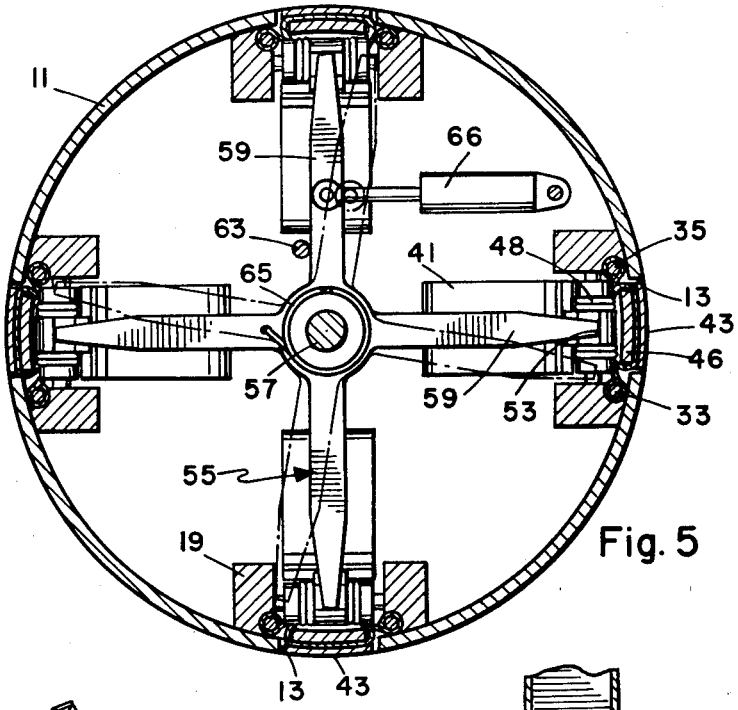
FIG. 5 is a sectional view taken on line 5—5 of FIG. 2.
Figure 6:
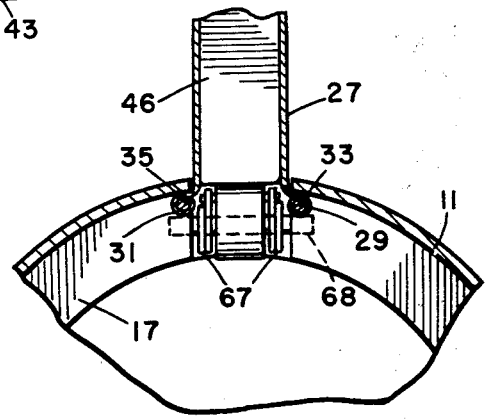
FIG. 6 is a sectional view taken on line 6—6 of FIG. 3.

A simple arrangement for holding the wings in the retracted position and releasing them all to the extended position at the same time is shown in the drawings. The latch mechanism includes the latch spider 55 rotatably mounted on an axial post 27 on the rear of bulkhead 19. The spider has a radial arm 59 for each wing. In the folded position a projection 61 on the spider arm 59 engages the lip 53 in the strut section 45 as shown in FIGS. 2 and 5. The latch spider 55 is biased to this latch position and held against a stop pin 63 by a torsion spring 65 around post 57. A single lip 53 serves to hold the structure in both the folded and external positions.

Latch spider 55 is rotated through a small angle to the unlatched position by an actuator 66 mounted on bulkhead 19 and coupled to one arm 59. The actuator is a short stroke single action device and may be powered by a solenoid, spring, squib, or other means controlled by a timer or command signal, depending on the type of missile. When the latch spider rotates, the arms 59 move away from under the lips 53, allowing the spring loaded leading edge struts to rotate about pin 68 and snap out as shown in FIG. 1 due to the force of springs 67. As previously mentioned, no cover removal is required prior to extending the wings 15 because the strut sections 43 perform the function of the slot covers in the closed position.

When the wing extends to the operative position shown in FIG. 1, the keeper 50 on strut plate section 46 is urged into engagement with lip 53 on strut plate section 45 to make the leading edge strut member a rigid construction. Lip 69 on the bottom of strut section 46 engages finger 71 extending from the bulkhead 17 and holds the wing in the operative position. The lip 53 serves the dual purpose of locking the wing in the retracted position and locking the wing in the operative position thus minimizing the number of parts required.

Having described our invention, we now claim:

1. In a missile having an elongated body, the body having an outer wall with a plurality of circumferentially spaced, longitudinally extended slots therein, a retractable self-erecting wing mounted in each slot, each wing comprising:

a single extendable strut member at the leading edge of the wing pivotally mounted in the body at the forward end of the slot and biased to swing outwardly from the body, said strut member including strut sections pivotally connected by pivot means for folding said strut member and said wing cover to the wing stored position and for extending said wing to the operative position;

means on said strut sections for urging said strut sections to the extended position;

a flexible wing cover affixed to said strut member for forming a wing with an internal air pocket in the extended position; said wing cover being movable with said strut member;

means at the bottom of said wing cover to secure the wing cover to the missile body;

retaining means for holding the wing cover in the stored position with said strut member and folded wing cover folded within the slot, said retaining means comprising a substantially U-shaped rod connected to the missile body and the bottom portion of said wing cover, with the legs of said U-shaped member sufficiently spaced apart to pass the folded wing cover and folded strut member therebetween; and extension means operatively mounted on the body for extending said wing.

2. The structure according to claim 1 wherein one of said strut sections forms the cover for the slot in the missile body.

3. The structure according to claim 2 wherein means is provided for retaining said wing in the stored condition.

* * * * *